US006068395A

United States Patent [19]

Ondracek

[11] Patent Number: 6,068,395

[45] Date of Patent: May 30, 2000

[54] POT STIRRING DEVICE WITH S-SHAPED STIRRING BLADES

[76] Inventor: John Ondracek, 860 Claremont St., Apt. 1004, Denver, Colo. 80220

[21] Appl. No.: 09/208,949

[22] Filed: Dec. 9, 1998

[51] Int. Cl.[7] ..... B01F 7/32

[52] U.S. Cl. ..... 366/129; 366/312; 366/325.8

[58] Field of Search ..... 366/129, 244–251, 366/309, 312, 313, 325.7, 325.8, 325.9, 325.91, 342, 343; 416/69, 70 R, 178, 187, 227 R; 99/323.5, 348

[56] References Cited

U.S. PATENT DOCUMENTS

| | | | |
|---|---|---|---|
| 1,141,528 | 6/1915 | Cunningham . | |
| 1,966,352 | 7/1934 | Mahony . | |
| 1,986,163 | 1/1935 | Rockwell . | |
| 2,208,337 | 7/1940 | Maslow . | |
| 2,269,736 | 1/1942 | Rogers . | |
| 2,670,938 | 3/1954 | Wittmann . | |
| 3,161,404 | 12/1964 | Jay . | |
| 4,151,792 | 5/1979 | Nearhood | 99/348 |
| 4,735,510 | 4/1988 | Barbour et al. | 366/343 |
| 4,844,355 | 7/1989 | Kemp, Jr. et al. | 366/343 |
| 5,326,168 | 7/1994 | Miura | 366/343 |
| 5,865,539 | 2/1999 | Rogers | 366/325.8 |

*Primary Examiner*—Charles E. Cooley
*Attorney, Agent, or Firm*—Henderson & Sturm LLP

[57] ABSTRACT

A pot stirring device 10 for mixing, stirring, and agitating the contents of a cooking pot 100 as well as cleaning and scraping the interior sides and bottom of the cooking pot 100, wherein the device 10 includes a handle member 20 having an elongated stem element 22 provided with a blade array 12 including a plurality of stirrer blade member 20 each having a generally S-shaped stirrer blade element 36 provided with a sharpened bottom edge 38 and a support leg element 34 provided with a sharpened outer edge 35. The sharpened edges 38 and 35 are provided to scrape the bottom and sides respectively of the interior of a cooking pot 100.

6 Claims, 2 Drawing Sheets

POT STIRRING DEVICE WITH S-SHAPED STIRRING BLADES

BACKGROUND OF THE INVENTION

1. Field of the Invention

The present invention relates to the field of cooking utensils in general, and in particular to a pot stirring device having a unique stirrer blade configuration for the agitation of the liquid contents of a cooking pot.

2. Description of Related Art

As can be seen by reference to the following U.S. Pat. Nos., 1,966,352; 2,208,337; 2,670,938; 4,735,510; and 5,326,168, the prior art is replete with myriad and diverse pot stirring devices for the agitation and mixing of the liquid contents of a pot.

While all of the aforementioned prior art constructions are more than adequate for the basic purpose and function for which they have been specifically designed, they are uniformly deficient with respect to their failure to provide a simple, efficient, and practical pot stirring device that has a novel stirrer blade configuration that can propel the liquid contents of the pot either towards or away from the center of the pot depending upon the direction of rotation of the stirrer blades.

As most cooks are aware, the main problem encountered in preparing soups,stews, gravies, and sauces is the tendency of the semi-liquid components to lump, congeal, overcook, and/or burn on the interior surfaces of a cooking pot due to incomplete, inefficient or insufficient stirring of the contents of the pot.

As a consequence of the foregoing situation, there has existed a longstanding need among cooks for a new and improved pot stirring apparatus that employs a novel stirrer blade configuration that not only scrapes the sides and bottom of the pot to prevent lumps and burnt clumps, but which also reverses the direction of the liquid agitation relative to the center of the pot, and the provision of such a construction is a stated objective of the present invention.

BRIEF SUMMARY OF THE INVENTION

Briefly stated, the pot stirring device that forms the basis of the present invention comprises a handle unit and a stirrer blade array projecting radially outwardly from the axis of the handle unit.

As will be explained in greater detail further on in the specification, the handle unit includes an elongated handle member having an enlarged head element provided with an elongated stem element.

In addition, the stirrer blade array in the preferred embodiment of the invention comprises a plurality of stirrer blade members arranged into two distinct groups of three blade members each, which creates two opposed turbulence gaps on opposite sides of the stirrer blade array.

Furthermore, each of the blade members includes an upper support arm element having a downwardly depending support leg element attached to a generally S-shaped stirrer blade element. The outboard edge of the support leg element and the bottom edge of the stirrer blade element are sharpened to provide scraping edges to clean the bottom and sides respectively of the interior of the cooking pot.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
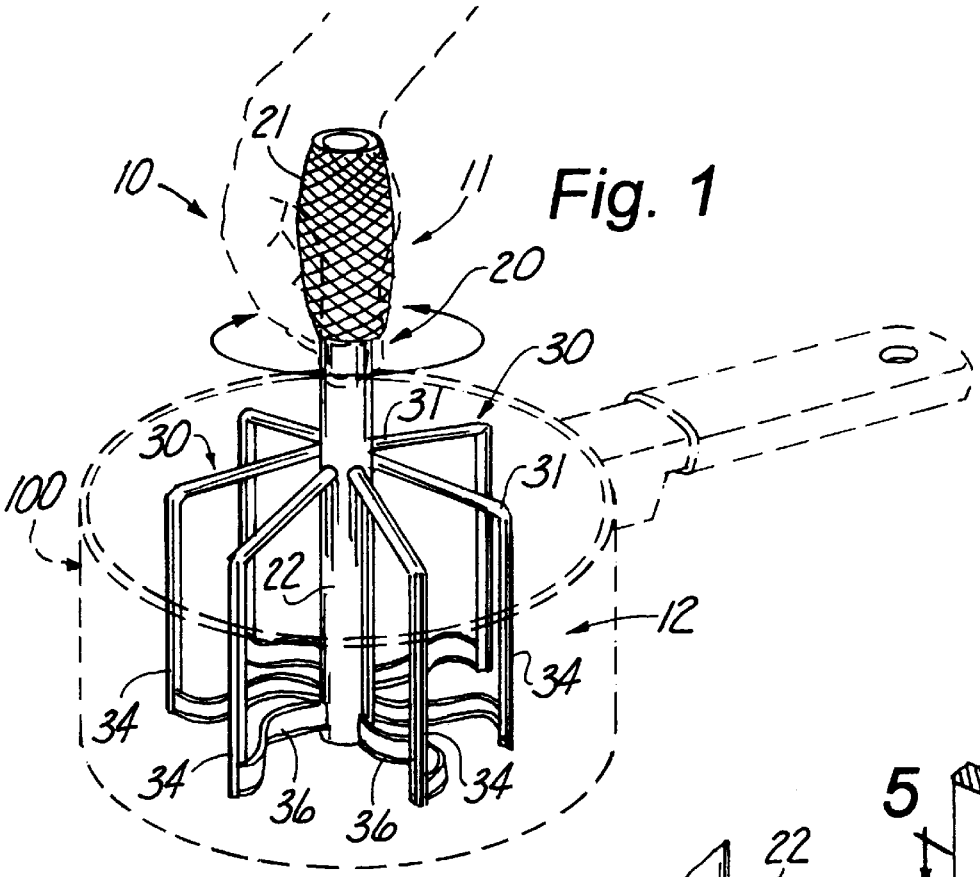
FIG. 1 is a perspective view of the pot stirring device of this invention disposed in a pot.
Figure 3:
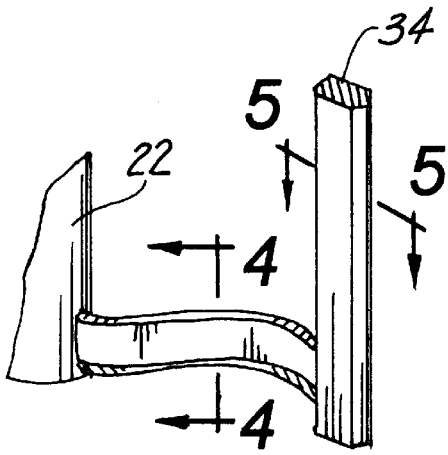
FIG. 3 is an isolated detail view of the lower portion of one of the stirrer blades.
Figure 2:
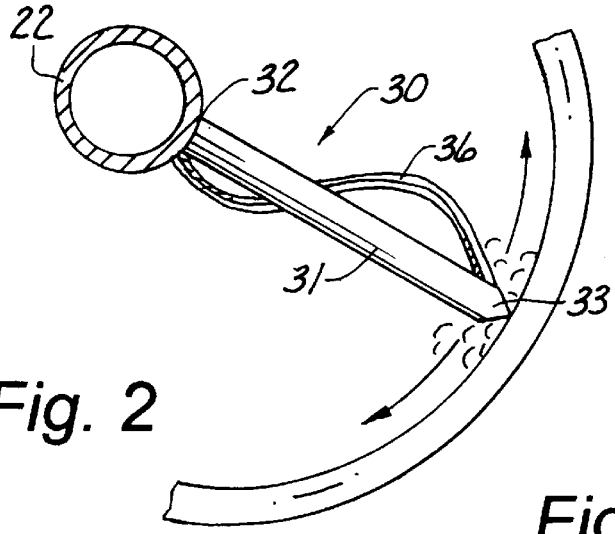
FIG. 2 is a top plan view of one of the stirrer blades engaged in a scraping relationship with the side of a pot.
Figure 4:
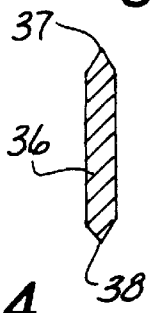
FIG. 4 is a cross sectional view taken through line 4—4 of FIG. 3.
Figure 5:
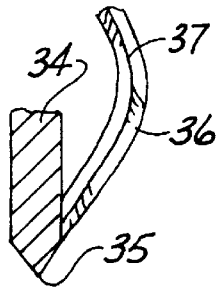
FIG. 5 is a cross sectional view taken through line 5—5 of FIG. 3.

As can be seen by reference to the drawings, and in particularly to FIG. 1, the pot stirring device that forms the basis of the present invention is designated generally by the reference number 10. The stirring device 10 comprises in general, a handle unit 11, and a stirrer blade array 12. These structural components will now be described in seriatim fashion.

Figure 6:
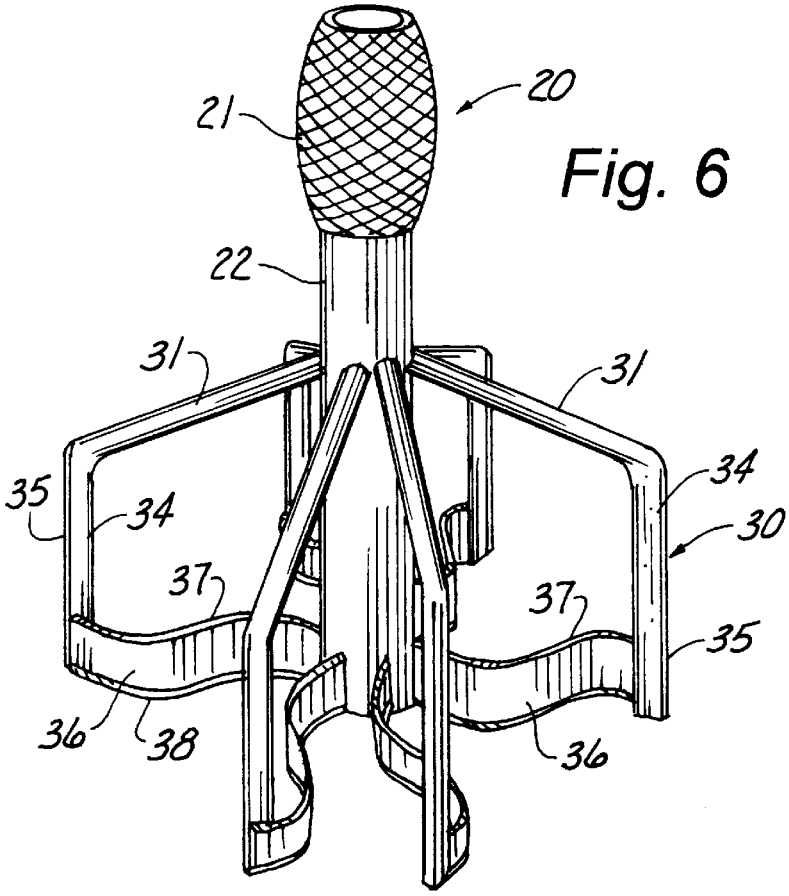
FIG. 6 is an isolated perspective view of the pot stirring device.

As can best be seen by reference to FIGS. 1 and 6, the handle unit 11 comprises an elongated handle member 20 having an enlarged knurled head 21 and an elongated generally cylindrical stem element 22. The height of the elongated stem element is substantially greater than the height of a cooking pot 100 in which it is employed.

Figure 7:
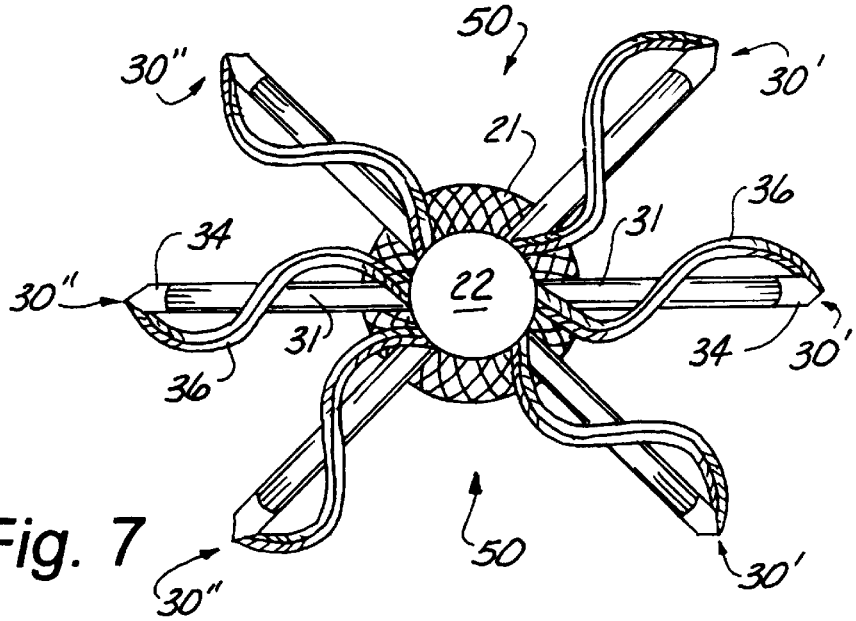
FIG. 7 is a bottom plan view of the pot stirring device.

As shown in FIGS. 1, 6, and 7, the stirrer blade array 12 comprises a plurality of identical stirrer blade members 30 radially arrayed around the periphery of the stem element 22 of the handle member 20.

In the preferred embodiment of the invention illustrated in the drawings, there are six stirrer blade members 30 arranged around the periphery of the stem element 22 of the handle member 20 in two distinct and separated groups of three blade members 30 each. There is a large space between the outer blade members 30' and 30" in each group of blade members 30. The large gaps designed generally as 50 between the groups of blade members 30' and 30" are designed to create opposed turbulence zones within the interior of a pot 100.

Turning now to FIGS. 2 through 5, it can be seen that each of the blade members 30 is provided with an upper support arm element 31 which is secured on the inboard end 32 to the upper end of the stem position 22 of the handle member 20. The outboard end 33 of the arm element 31 is provided with a downwardly depending support leg element 34 having a pointed outer edge 35.

In addition, the lower end of both the stem portion 22 of the handle member 20 and the leg element 34 of the blade member 30 are provided with a generally thin S-shaped stirrer blade element 36 having a sharpened upper end 37, as well as a sharpened lower end 38. The outboard edge 35 of the support leg element 34 is designed to scrape the inside periphery of the cooking pot 100. The bottom edge 38 of the stirrer blade element 36 is designed to scrape the bottom of the cooking pot 100 to prevent the contents of the pot 100 from sticking to the interior surfaces of the pot 100.

As can best be seen by reference to FIG. 7, the S-shaped configuration of the stirrer blade element 36 force the liquid contents of the pot to be directed to the center of the pot when the S-shaped is rotated in the clockwise direction. The liquid contents will be directed away from the center of the pot when the S-shape is rotated in the counterclockwise direction.

As a consequence, the user can dictate the direction of the circulation of the liquid contents if the pot has a tendency to overcook foodstuffs in the center or on one of the sides due to imperfections in the manufacture of the pot and/or to insure complete mixing of the contents of the pot.

It should further be noted that while this device 10 has previously been described as having two distinct groups of three blade members 30', 30" each, the device could also be manufactured with a greater or lesser number of blade members 30 and the blade members 30 could also be equally spaced from one another.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A pot stirring device for stirring the contents of and scraping the bottom and sides of a cooking pot wherein the pot stirring device consists of:

a handle unit including an elongated handle member having an enlarged head element and an elongated stem element; and a stirrer blade array including a plurality of stirrer blade members projecting radially outwardly from said elongated stem element wherein each blade member includes a generally S-shaped stirrer blade element connected on one end to the lower end of the stem element wherein the stirrer blade element is provided with a sharpened lower end, and a sharpened upper end; and wherein each of the stirrer blade members further comprises a support arm element having one end connected to said stem element wherein the other end of the support arm element is provided with a downwardly depending support leg element having a lower end connected to the stirrer blade element, whereby a completely open area is formed between said S-shaped stirrer blade element, said support arm element, said support leg element, and said stem element.

2. The device as in claim 1 wherein the stirrer blade element has an outboard end and the lower end of the support leg element is connected to said outboard end.

3. The device as in claim 2 wherein the support leg element is provided with a sharpened outer edge.

4. The device as in claim 3 wherein the plurality of stirrer blade members comprises two groups of equal number blade members.

5. The device as in claim 4 wherein the two groups of blade members are spaced from one another to produce two turbulence gaps.

6. The device as in claim 5 wherein the two turbulence gaps are opposed from one another.

* * * * *